US012595794B2

(12) United States Patent
Okaguchi et al.

(10) Patent No.: US 12,595,794 B2
(45) Date of Patent: Apr. 7, 2026

(54) FLUID CONTROL DEVICE

(71) Applicant: Murata Manufacturing Co., Ltd., Kyoto (JP)

(72) Inventors: Kenjiro Okaguchi, Kyoto (JP); Hiroki Achiwa, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 589 days.

(21) Appl. No.: 17/822,243

(22) Filed: Aug. 25, 2022

(65) Prior Publication Data

US 2022/0403835 A1 Dec. 22, 2022

Related U.S. Application Data

(63) Continuation of application No. PCT/JP2020/045558, filed on Dec. 8, 2020.

(30) Foreign Application Priority Data

Feb. 26, 2020 (JP) ..... 2020-030026

(51) Int. Cl.

| | |
|---|---|
| ***F04B 49/03*** | (2006.01) |
| ***F04B 23/04*** | (2006.01) |
| ***F04B 43/04*** | (2006.01) |
| ***F04B 49/06*** | (2006.01) |
| ***F04B 49/08*** | (2006.01) |

(52) U.S. Cl.

CPC ..... *F04B 49/03* (2013.01); *F04B 23/04* (2013.01); *F04B 43/046* (2013.01); *F04B 49/065* (2013.01); *F04B 49/08* (2013.01); *F04B 2207/02* (2013.01)

(58) Field of Classification Search

CPC ..... F04B 43/046; F04B 45/047; F04B 25/00; F04B 25/005; F04B 23/04; F04B 23/06

See application file for complete search history.

(56) References Cited

U.S. PATENT DOCUMENTS 3,150,592 A * 9/1964 Stec ..... F04B 43/095 417/322
2012/0051946 A1* 3/2012 Lee ..... F04B 43/046 417/413.2

(Continued)

FOREIGN PATENT DOCUMENTS

JP 2004-169706 A 6/2004
JP 2013-194654 A 9/2013

(Continued)

OTHER PUBLICATIONS

International Search Report for PCT/JP2020/045558 dated Jan. 19, 2021.

*Primary Examiner* — Thomas Fink
(74) *Attorney, Agent, or Firm* — McDonald Hopkins LLC

(57) ABSTRACT

A fluid control device includes a piezoelectric pump, a piezoelectric pump, a container, and a control unit. The piezoelectric pumps and are connected in series. The piezoelectric pump is an upstream-side pump, and the piezoelectric pump is a downstream-side pump. The control unit controls driving of the piezoelectric pumps. The control unit makes the driving start timing of the piezoelectric pump on an upstream side earlier than the driving start timing of the piezoelectric pump on a downstream side.

16 Claims, 16 Drawing Sheets

(56) References Cited

U.S. PATENT DOCUMENTS

| | | | | |
|---|---|---|---|---|
| 2013/0251541 | A1 | 9/2013 | Okamoto | |
| 2017/0365768 | A1* | 12/2017 | Okaguchi | B06B 1/0207 |
| 2018/0117243 | A1* | 5/2018 | Maguire | A61M 5/14228 |
| 2019/0343405 | A1 | 11/2019 | Tanaka | |
| 2020/0378380 | A1 | 12/2020 | Okaguchi | |

FOREIGN PATENT DOCUMENTS

| | | | |
|---|---|---|---|
| JP | 6160800 | B1 | 7/2017 |
| WO | 2012/140931 | A1 | 10/2012 |
| WO | 2018/142975 | A1 | 8/2018 |
| WO | 2019/198305 | A1 | 10/2019 |

* cited by examiner

| ST | 1 | 2 | 3 | 1 | 2 | 3 |
|---|---|---|---|---|---|---|
| PUMP 21 (DOWNSTREAM) | OFF | ON | OFF | OFF | ON | OFF |
| PUMP 22 (UPSTREAM) | ON | ON | OFF | ON | ON | OFF |
| VALVE 30 | CL | CL | OP | CL | CL | OP |

FIG. 4
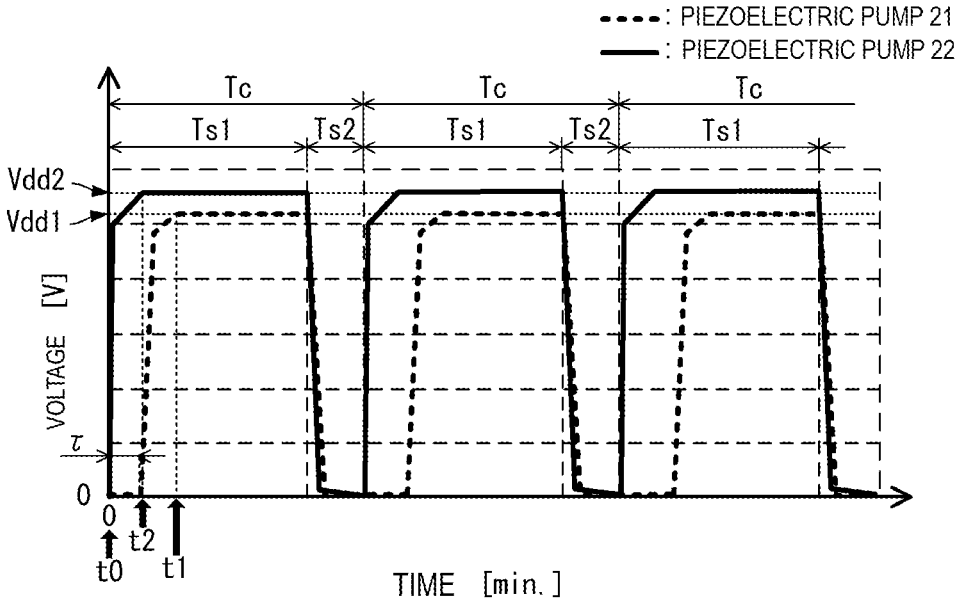
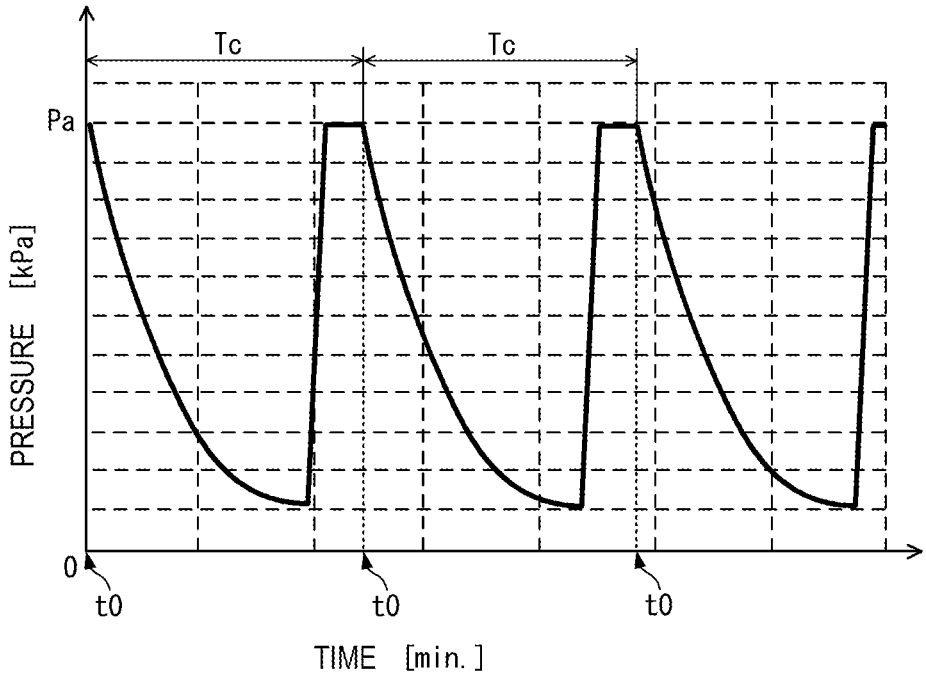
FIG. 5

FIG. 7
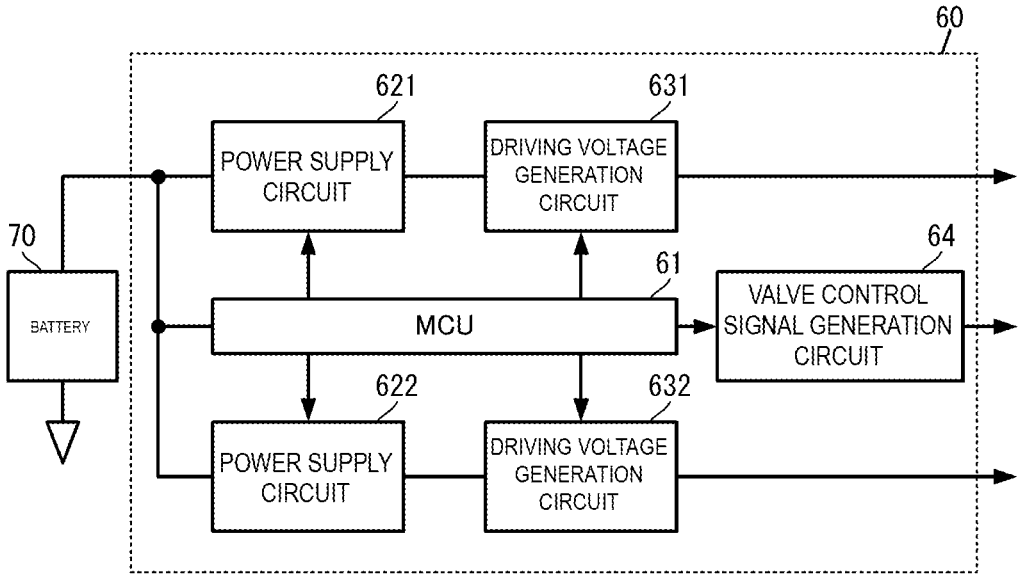
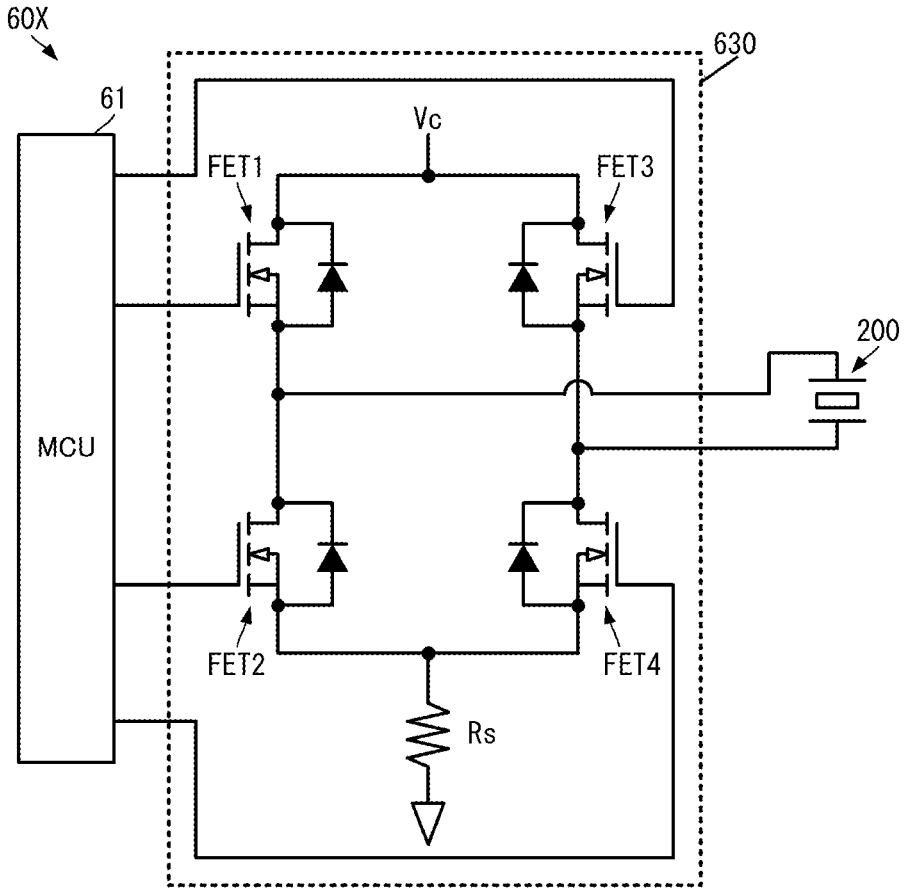
FIG. 8

| ST | 1A | 2A | 3A | 4A | 1A | 2A | 3A | 4A |
|---|---|---|---|---|---|---|---|---|
| PUMP 21 (DOWNSTREAM) | OFF | ON | OFF | OFF | OFF | ON | OFF | OFF |
| PUMP 22 (UPSTREAM) | ON | ON | ON | OFF | ON | ON | ON | OFF |
| VALVE 30 | CL | CL | OP | OP | CL | CL | OP | OP |

FIG. 16
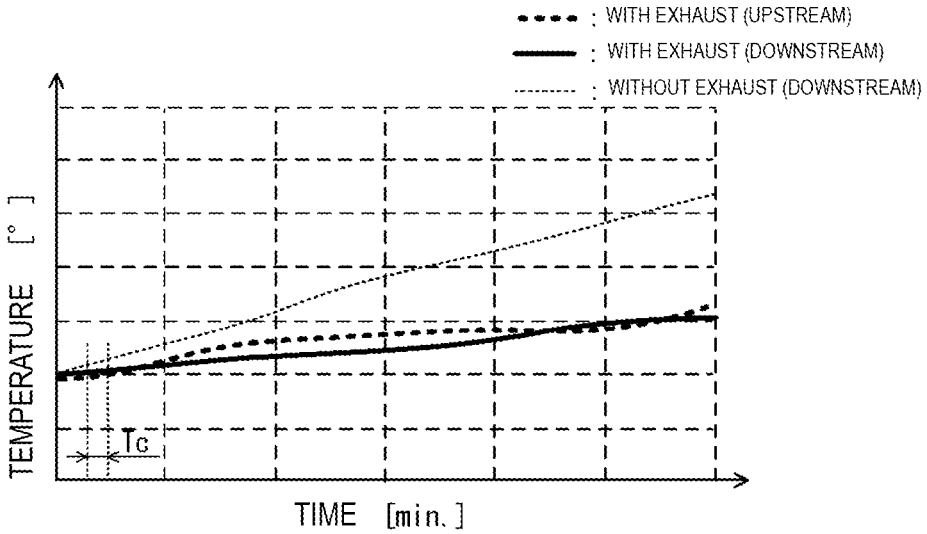
FIG. 17
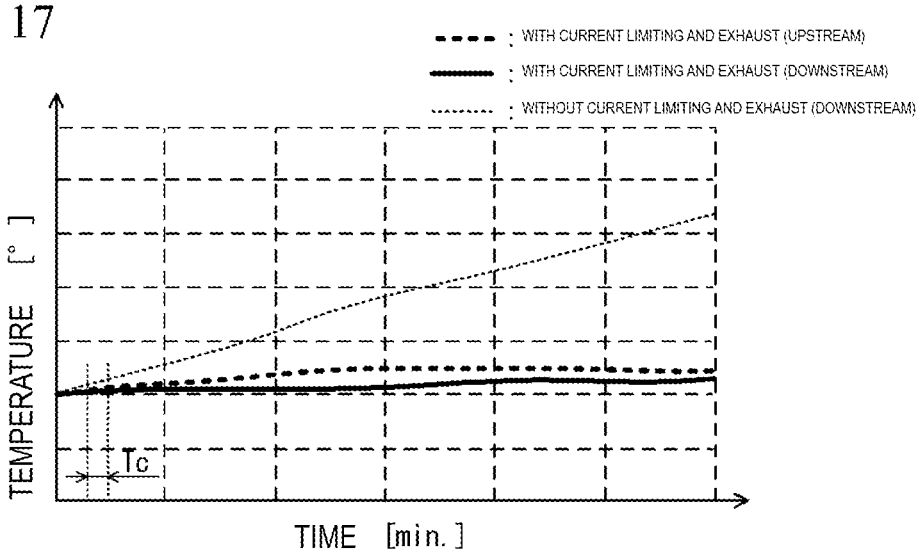
| ST | 1B | 2B | 3B | 4B | 1B | 2B | 3B | 4B |
|---|---|---|---|---|---|---|---|---|
| PUMP 21 (DOWNSTREAM) | OFF | ON | OFF | OFF | OFF | ON | OFF | OFF |
| PUMP 22 (UPSTREAM) | ON | ON | OFF | ON | ON | ON | OFF | ON |
| VALVE 30 | CL | CL | OP | OP | CL | CL | OP | OP |
FIG. 18

FIG. 21
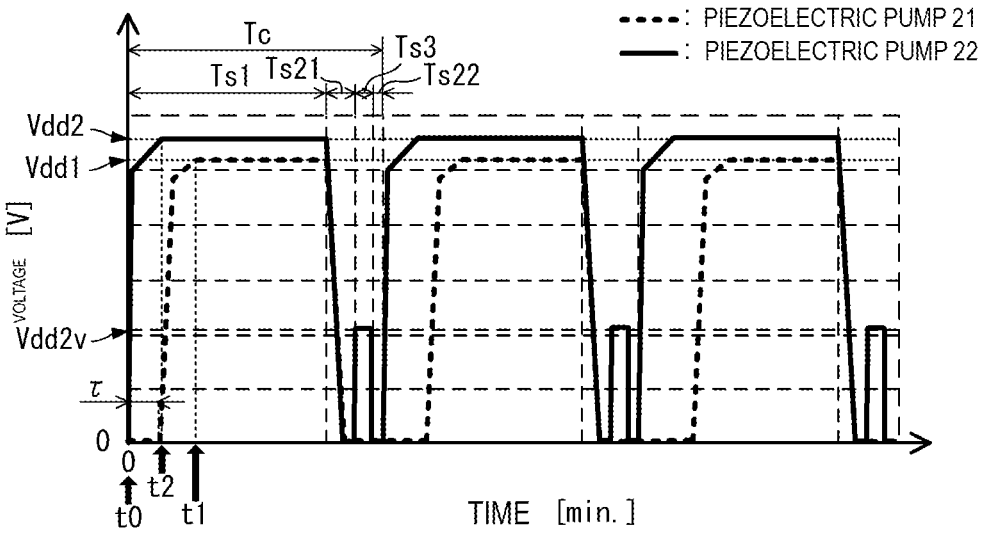
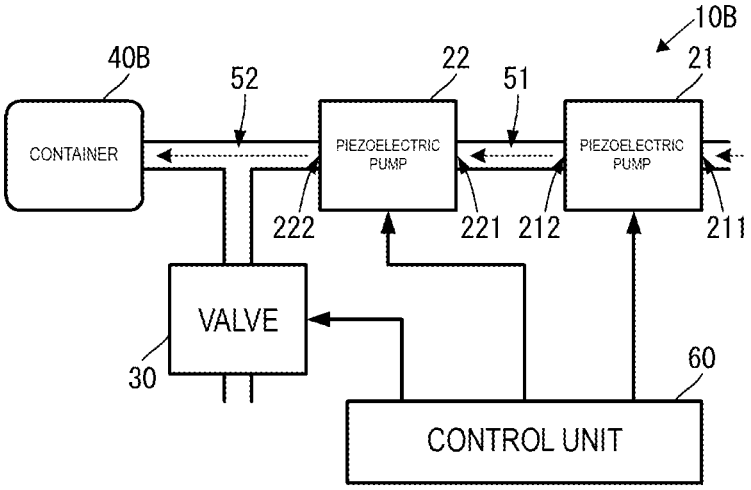
FIG. 22

FLUID CONTROL DEVICE

CROSS REFERENCE TO RELATED APPLICATION

This is a continuation of International Application No. PCT/JP2020/045558 filed on Dec. 8, 2020 which claims priority from Japanese Patent Application No. 2020-030026 filed on Feb. 26, 2020. The contents of these applications are incorporated herein by reference in their entireties.

BACKGROUND OF THE DISCLOSURE

Field of the Disclosure

The present disclosure relates to a fluid control device that uses a piezoelectric pump to move fluids in a predetermined direction.

Description of the Related Art

Patent Document 1 discloses a fluid control device including a piezoelectric pump and a driving circuit. The driving circuit is connected to the piezoelectric pump and supplies a driving voltage to the piezoelectric pump. The piezoelectric pump sucks fluids from a suction inlet and discharges the fluids from a discharge outlet in accordance with the driving voltage. This moves fluids in a predetermined direction.
Patent Document 1: Japanese Patent No. 6160800

BRIEF SUMMARY OF THE DISCLOSURE

For improvement of performance such as pressure, the use of a fluid control device is considered in which a plurality of piezoelectric pumps are connected in series.

For example, when two piezoelectric pumps (a first piezoelectric pump and a second piezoelectric pump) are connected in series, the discharge outlet of the first piezoelectric pump and the suction inlet of the second piezoelectric pump communicate with each other. At that time, the first piezoelectric pump and the second piezoelectric pump are typically simultaneously driven.

However, the amount of the heat generated by a downstream piezoelectric pump (the second piezoelectric pump in the above case) increases with this configuration and under this control. In particular, when a high flow rate is needed and a large amount of power is supplied, the amount of the heat generated further increases and the likelihood of failure increases. When a temperature change rate at the time of the heat generation increases, the likelihood of failure further increases.

Accordingly, it is a possible benefit of the present disclosure to reduce the temperature change rates of a plurality of series-connected piezoelectric pumps.

A fluid control device according to the present disclosure includes a first pump, a second pump, a container, a first communicating path, a second communicating path, and a first control unit. The first pump has a first hole and a second hole and is configured to move a fluid between the first hole and the second hole. The second pump has a third hole and a fourth hole and is configured to move a fluid between the third hole and the fourth hole. The first communicating path communicates with the second hole and the third hole. The second communicating path communicates with the fourth hole and the container. The first control unit is configured to control driving of the first pump and the second pump. The first control unit starts or stops driving of the first pump and the second pump. The first control unit makes a driving start timing of an upstream-side pump with respect to the fluid earlier than a driving start timing of a downstream-side pump with respect to the fluid. The upstream-side pump is one of the first pump and the second pump, and the downstream-side pump is the other one of the first pump and the second pump.

As a result, the change in the temperature of the downstream-side pump is stabilized.

According to the present disclosure, the temperature change rates of a plurality of series-connected piezoelectric pumps can be reduced. This can lead to the suppression of the occurrence of failures in these multiple piezoelectric pumps.

BRIEF DESCRIPTION OF THE SEVERAL VIEWS OF THE DRAWINGS

FIG. 4 is a diagram illustrating the voltage waveform of a driving signal for each piezoelectric pump according to the first embodiment.

FIG. 5 is a diagram illustrating a pressure change pattern made by a fluid control device of the present application.

FIG. 7 is a functional block diagram of a control unit in a fluid control device.

FIG. 8 is a circuit diagram illustrating a first example of a control unit of a separately-excited oscillation type.

FIG. 16 is a diagram illustrating temperature change patterns with and without exhaust.

FIG. 17 is a diagram illustrating temperature change patterns when both current limiting and exhaust are performed and a temperature change pattern when neither current limiting nor exhaust is performed.

FIG. 18 is a state transition diagram of control processing performed by a fluid control device according to a fifth embodiment.

FIG. 21 is a diagram illustrating the voltage waveform of a driving signal for each piezoelectric pump according to the fifth embodiment.

FIG. 22 is a block diagram illustrating the configuration of a fluid control device according to a sixth embodiment of the present disclosure.

DETAILED DESCRIPTION OF THE DISCLOSURE

First Embodiment

Figures 1, 2:
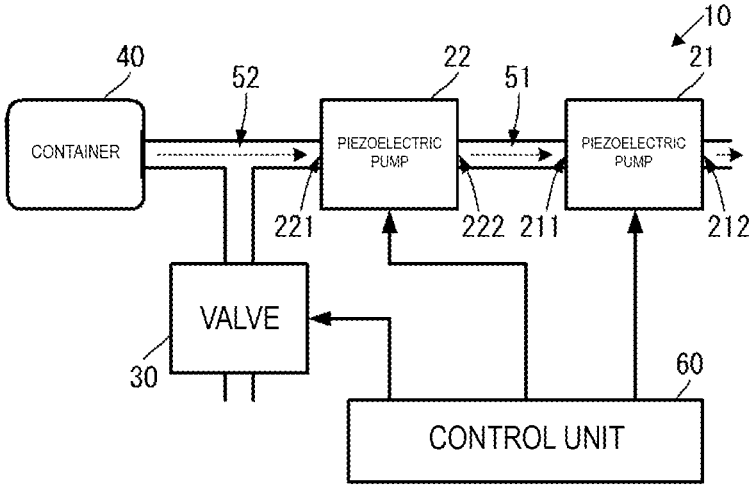
FIG. 1 is a block diagram illustrating the configuration of a fluid control device according to a first embodiment.
FIG. 2 is a state transition diagram of control processing performed by a fluid control device according to the first embodiment.

A fluid control device according to the first embodiment of the present disclosure will be described with reference to the drawings. FIG. 1 is a block diagram illustrating the configuration of a fluid control device according to the first embodiment.

As illustrated in FIG. 1, a fluid control device 10 includes a piezoelectric pump 21, a piezoelectric pump 22, a valve 30, a container 40, a communicating path 51, a communicating path 52, and a control unit 60. The fluid control device 10 sucks a fluid from the container 40 and is used in, for example, a milking machine.

The piezoelectric pump 21 has a hole 211 and a hole 212 provided on a housing. The piezoelectric pump 21 includes a piezoelectric element. The housing includes a pump chamber. The pump chamber communicates with the holes 211 and 212. The housing, the pump chamber, and the piezoelectric element are not illustrated in the drawing.

The piezoelectric pump 21 moves a fluid between the holes 211 and 212 by changing the volume or pressure of the pump chamber using the displacement of the piezoelectric element caused by a driving voltage. In this embodiment, the hole 211 is a suction inlet, and the hole 212 is a discharge outlet. The piezoelectric pump 21 corresponds to a "first pump" of the present disclosure.

The piezoelectric pump 22 has a hole 221 and a hole 222 provided on a housing. The piezoelectric pump 22 includes a piezoelectric element. The housing includes a pump chamber. The pump chamber communicates with the holes 221 and 222. The housing, the pump chamber, and the piezoelectric element are not illustrated in the drawing.

The piezoelectric pump 22 moves a fluid between the holes 221 and 222 by changing the volume or pressure of the pump chamber using the displacement of the piezoelectric element caused by a driving voltage. In this embodiment, the hole 221 is a suction inlet, and the hole 222 is a discharge outlet. The piezoelectric pump 22 corresponds to a "second pump" of the present disclosure.

The communicating path 51 is tubular. The hole 211 of the piezoelectric pump 21 and the hole 222 of the piezoelectric pump 22 communicate with each other via the communicating path 51. The communicating path 52 is tubular. The hole 221 of the piezoelectric pump 22 and the container 40 communicate with each other via the communicating path 52. The communicating path 51 corresponds to a "first communicating path" of the present disclosure, and the communicating path 52 corresponds to a "second communicating path" of the present disclosure.

The valve 30 is connected to the communicating path 52. The valve 30 opens the inside of the communicating path 52 to the outside (valve open state) or closes the inside of the communicating path 52 from the outside (valve close state) in response a valve control signal. By controlling the opening and closing of the valve 30 as appropriate, the change in the pressure of the container 40 can be stably controlled. This also contributes to the reduction of the variation in a temperature change rate to be described below.

The control unit 60 generates driving signals for the piezoelectric pumps 21 and 22 and supplies these driving signals to the respective piezoelectric pumps 21 and 22. The control unit 60 generates a valve control signal and supplies the valve control signal to the valve 30. The control unit 60 performs driving control of the piezoelectric pumps 21 and 22 and opening/closing control of the valve 30 in synchronization with each other. The control unit 60 repeats the driving control of the piezoelectric pumps 21 and 22 and the opening/closing control of the valve 30 in a driving control cycle. The driving control cycle is set in advance.

In outline, the fluid control device 10 drives the piezoelectric pumps 21 and 22 when performing the closing control of the valve 30, moves a fluid from the container 40 to the communicating path 52, the piezoelectric pump 22, the communicating path 51, and the piezoelectric pump 21 in this order, and discharges the fluid from the hole 212 of the piezoelectric pump 21. That is, the piezoelectric pump 22 corresponds to an "upstream-side pump" of the present disclosure, and the piezoelectric pump 21 corresponds to a "downstream-side pump" of the present disclosure. The fluid control device 10 stops the piezoelectric pumps 21 and 22 and performs the opening control of the valve 30. The fluid control device 10 repeats these operations in the driving control cycle.

A configuration according to this embodiment is more effective in the case where the driving control and the opening/closing control are repeated, but is also applicable to the case where the driving control and the opening/closing control are performed only once.

(Description of Details of Control)

FIG. 2 is a state transition diagram of control processing performed by a fluid control device according to the first embodiment.

As illustrated in FIG. 2, in a state ST1 synchronized with the start timing of a driving control cycle, the fluid control device 10 starts the driving of the piezoelectric pump 22 (the piezoelectric pump 22: ON) and performs the closing control of the valve 30 (the valve 30: CL). At that time, the fluid control device 10 stops the piezoelectric pump 21 (the piezoelectric pump 21: OFF).

In a state ST2 subsequent to the state ST1, the fluid control device 10 maintains the closed state of the valve 30 (the valve 30: CL) and starts the driving of the piezoelectric pump 21 (the piezoelectric pump 21: ON) while maintaining the driving state of the piezoelectric pump 22 (the piezoelectric pump 22: ON).

In a state ST3 subsequent to the state ST2, the fluid control device 10 performs the opening control of the valve 30 (the valve 30: OP). At the same time, the fluid control device 10 stops the piezoelectric pumps 21 and 22 (the piezoelectric pumps 21 and 22: OFF).

The fluid control device 10 performs a set of these states ST1, ST2, and ST3 in one driving control cycle and repeats this control.

Thus, the fluid control device 10 drives an upstream-side pump earlier than a downstream-side pump in one driving control cycle.

Figure 3:
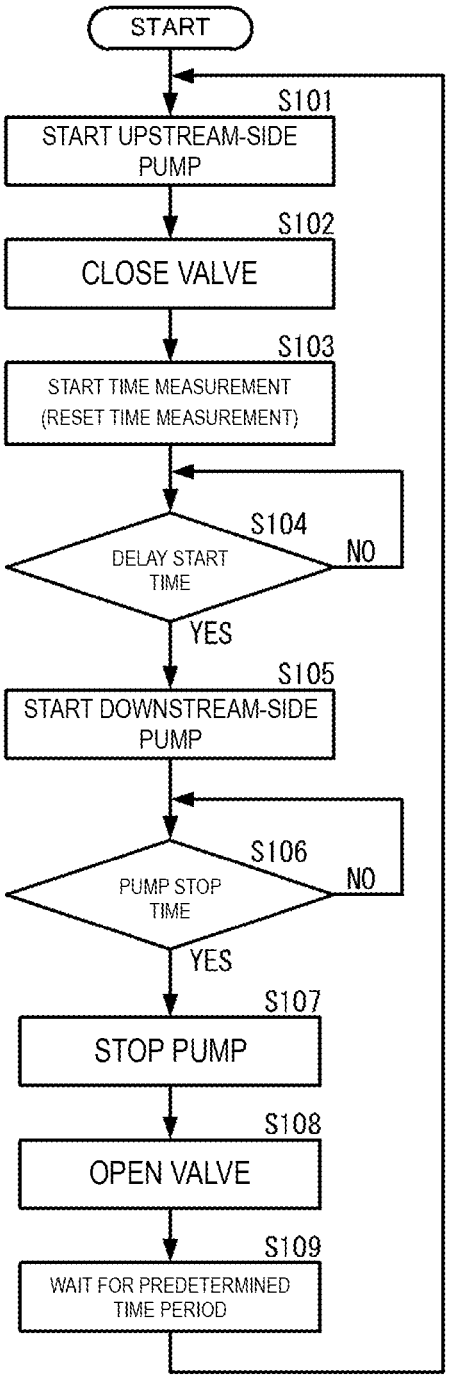
FIG. 3 is a flowchart of a control process performed by a fluid control device according to the first embodiment of the present disclosure.

For achievement of this control, the control unit 60 in the fluid control device 10 performs the control process illustrated in FIG. 3. FIG. 3 is a flowchart of a control process performed by a fluid control device according to the first embodiment of the present disclosure.

As illustrated in FIG. 3, the control unit 60 starts an upstream-side pump (the piezoelectric pump 22 in the first embodiment) at the start timing of one driving control cycle (S101). The control unit 60 performs closing control of the valve 30 (S102). The control unit 60 starts time measurement or resets the time measurement when the control is in progress (S103). Steps S101, S102, and S103 are performed at substantially the same time. Steps S101, S102, and S103 may be performed with some time differences or the order of these steps may be replaced, within the range where the functions of the fluid control device 10 can be achieved.

The control unit 60 refers to the measured time and continues the time measurement until a delay start time (S104: NO). Upon reaching the delay start time (S104: YES), the control unit 60 starts a downstream-side pump (the piezoelectric pump 21 in the first embodiment) (S105).

The control unit 60 causes the upstream-side pump and the downstream-side pump to continue respective operations until a pump stop time (S106: NO).

Upon reaching the pump stop time (S106: YES), the control unit 60 stops the upstream-side pump and the downstream-side pump (S107). The control unit 60 performs the opening control of the valve 30 (S108). Steps S107 and S108 are performed at substantially the same time. Steps S107 and S108 may be performed with some time differences within the range where the functions of the fluid control device 10 can be achieved.

The fluid control device 10 waits for a predetermined time period in the state where the upstream-side pump and the downstream-side pump stop and the valve 30 is under the opening control (S109), ends one driving control cycle, and returns to step S101.

Thus, in the fluid control device 10, the downstream-side pump starts the operation thereof in the state where a fluid continuously flows thereto in response to the operation of the upstream-side pump. Accordingly, the temperature change rate of the downstream-side pump is less likely to vary even if the temperature of the downstream-side pump varies during the continuous operation of the downstream-side pump. That is, the temperature change rate of the downstream-side pump becomes stable. This leads to the suppression of occurrence of a failure in the downstream-side pump.

The temperature of the upstream-side pump is relatively lower than that of the downstream-side pump. Accordingly, the fluid control device 10 can suppress the occurrence of failures in a plurality of series-connected pumps.

(Concrete Example of Driving Signal Generated by Control Unit 60 for Piezoelectric Pumps 21 and 22)

FIG. 4 is a diagram illustrating the voltage waveform of a driving signal for each piezoelectric pump according to the first embodiment. Referring to FIG. 4, t0 represents the start timing of a driving control cycle. t1 represents the first timing at which the driving voltage of the piezoelectric pump 21 (downstream-side pump) reaches a normal operation driving voltage. t2 represents the first timing at which the driving voltage of the piezoelectric pump 22 (upstream-side pump) reaches the normal operation driving voltage. Tc represents the driving control cycle. Ts1 represents a driving time. Ts2 represents a non-driving time and corresponds to a waiting time in step S109 described above. The driving control cycle Tc is an added time of the driving time Ts1 and the non-driving time Ts2.

As illustrated in FIG. 4, the fluid control device 10 starts to apply the driving voltage to the piezoelectric pump 22, which is the upstream-side pump, at the start timing t0 of the driving control cycle. At that time, the fluid control device 10 gradually increases the driving voltage at a predetermined voltage change rate. At the timing (time) t2, the fluid control device 10 sets the driving voltage being applied to the piezoelectric pump 22 at a normal operation driving voltage Vdd2 and keeps the driving voltage constant thereafter.

The fluid control device 10 starts to apply the driving voltage to the piezoelectric pump 21, which is the downstream-side pump, after a lapse of a delay time $\tau$ from the start timing to. At that time, the fluid control device 10 gradually increases the driving voltage at a predetermined voltage change rate. It is desired that the delay time $\tau$ be shorter than, for example, the timing at which the transition from a flow rate mode to a pressure mode is made. The flow rate mode is a mode in which the pressure is relatively low and difficult to increase and the flow rate is large. The pressure mode is a mode in which the pressure is relatively high and the flow rate is difficult to increase. It is desired that the delay time $\tau$ be shorter than, for example, the time required to reach approximately one-third of a pressure having the largest absolute value, that is, the pressure immediately before the valve 30 is subjected to the opening control.

At the timing (time) t2, the fluid control device 10 sets the driving voltage being applied to the piezoelectric pump 21 at a normal operation driving voltage Vdd1 and keeps the driving voltage constant thereafter. It is desired that the driving voltage Vdd1 for the piezoelectric pump 21 be lower than the driving voltage Vdd2 for the piezoelectric pump 22. As a result, the increase in the temperature of the downstream-side pump is easily suppressed.

The fluid control device 10 stops driving the piezoelectric pumps 21 and 22 after a lapse of the driving time Ts1 from the start timing to.

With such control, the application time of a driving voltage to the piezoelectric pump 21 becomes shorter than that of a driving voltage to the piezoelectric pump 22 as described above. That is, the application time of a driving voltage to the downstream-side pump becomes shorter than that of a driving voltage to the upstream-side pump. As a result, the increase in the temperature of the downstream-side pump is suppressed.

The application time of the normal operation driving voltage Vdd1 to the piezoelectric pump 21, which is the downstream-side pump, becomes shorter than that of the normal operation driving voltage Vdd2 to the piezoelectric pump 22, which is the upstream-side pump. As a result, the increase in the temperature of the downstream-side pump is further suppressed.

(Pressure Change Made by Configuration of Fluid Control Device 10)

FIG. 5 is a diagram illustrating a pressure change pattern made by a fluid control device of the present application. Referring to FIG. 5, the horizontal axis represents time and the vertical axis represents pressure (discharge pressure).

As illustrated in FIG. 5, with the configuration and the control of the fluid control device 10, the pressure changes in the driving control cycle. That is, when the valve 30 is closed and the operations of the piezoelectric pumps 22 and 21 start in this order from the start timing t0 of one driving control cycle, the pressure gradually decreases from the start timing of one driving control cycle. The pressure reaches the lowest immediately before the piezoelectric pumps 21 and 22 stop and the valve 30 opens. When the piezoelectric pumps 21 and 22 stop and the valve 30 opens, the pressure returns to an approximately initial value. By repeating this operation, the fluid control device 10 can efficiently suck a fluid from the container 40.

(Effect of Fluid Control Device 10 on Temperature Change Rate)

Figure 6A:
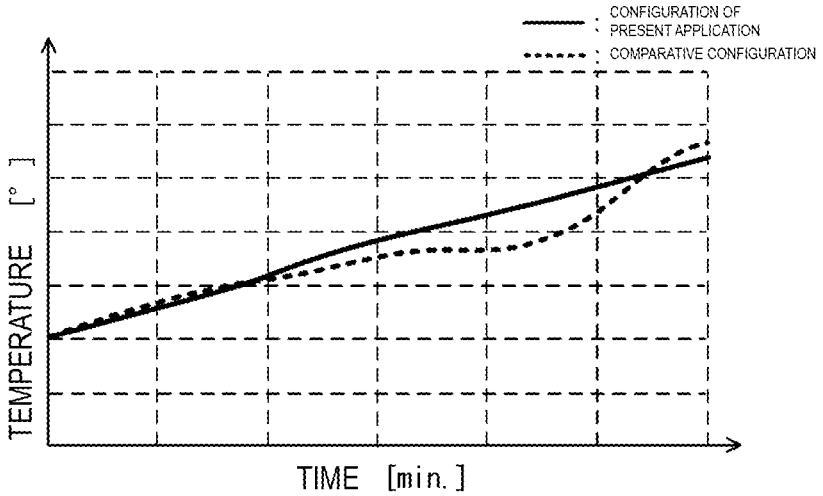
FIG. 6A is a diagram illustrating temperature change patterns of a fluid control device according to the first embodiment and a comparative configuration.
Figure 6B:
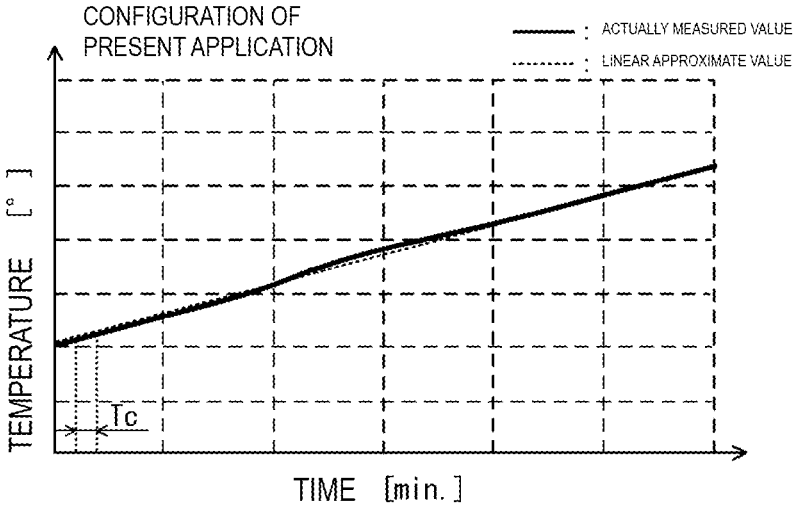
FIG. 6B is a diagram illustrating a temperature change pattern of a fluid control device according to the first embodiment.
Figure 6C:
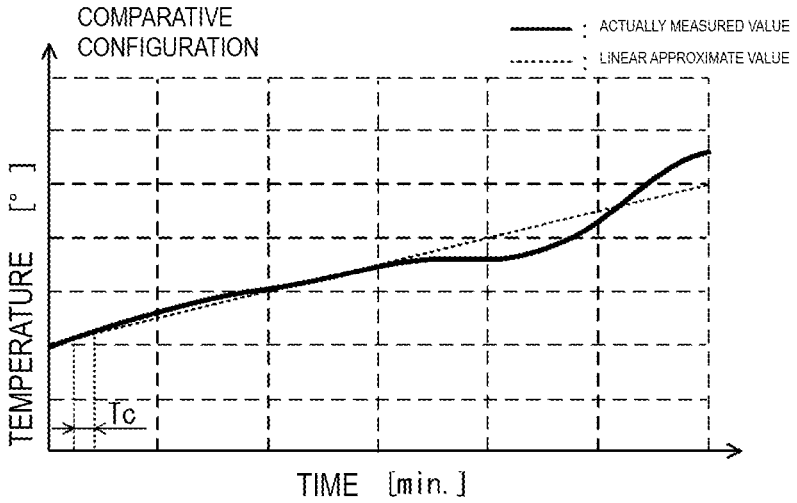
FIG. 6C is a diagram illustrating a temperature change pattern of a fluid control device having a comparative configuration.

FIG. 6A is a diagram illustrating temperature change patterns of a fluid control device according to the first embodiment and a comparative configuration, FIG. 6B is a diagram illustrating a temperature change pattern of a fluid control device according to the first embodiment, and FIG. 6C is a diagram illustrating a temperature change pattern of a comparative configuration. Referring to FIGS. 6A, 6B, and 6C, the horizontal axis represents time and the vertical axis represents temperature near the discharge outlet of the downstream-side pump. In the comparative configuration, the driving time control described in the first embodiment is not performed. Referring to FIG. 6A, the solid line represents the case of a fluid control device according to the first embodiment and the broken line represents the case of a comparative configuration. Referring to FIGS. 6B and 6C, the solid line represents an actually measured value of temperature and the broken line represents a linear approximate value of an actually measured value of temperature. Referring to FIGS. 6B and 6C, Tc represents the above driving control cycle.

As illustrated in FIGS. 6A, 6B, and 6C, the variation in temperature change rate is reduced while the temperature of the downstream-side pump increases with the configuration of the fluid control device 10.

The variation in temperature change rate can be defined by, for example, a difference between difference values between an actually measured value and a linear approximate value at a plurality of times. For example, definition can be performed using a difference $\nabla tab$ between a difference value $\Delta ta$ between an actually measured value and a linear approximate value at a time to and a difference value $\Delta tb$ between an actually measured value and a linear approximate value at a time tb (different from ta). Accordingly, the smaller the difference $\nabla tab$ is, the smaller the variation in temperature change rate is. The larger the difference $\nabla tab$ is, the larger the variation in temperature change rate is.

Thus, as illustrated in FIGS. 6A, 6B, and 6C, the difference $\nabla tab$ can be reduced and the variation in temperature change rate can be reduced with the configuration of the fluid control device 10.

The reduction in the variation in temperature change rate leads to the suppression of a rapid temperature change. If such a rapid temperature change occurs, a stress is applied to a piezoelectric pump. Accordingly, by suppressing a rapid temperature change, the fluid control device 10 can prevent the downstream-side pump from being broken. Although not illustrated, the temperature of the upstream-side pump is lower than that of the downstream-side pump. The higher the temperature is, the larger the adverse effect on a piezoelectric pump is. Accordingly, the upstream-side pump with a low temperature can also be prevented from being broken.

As a result, the fluid control device 10 can suppress the occurrence of the failures caused by the heat including the breakage of a plurality of series-connected pumps.

The rate of change of a driving voltage for the piezoelectric pump 21 may be lower than that of a driving voltage for the piezoelectric pump 22 at the time of transition in the fluid control device 10. As a result, the rapid temperature change of the downstream-side pump can be further reduced. The fluid control device 10 can further suppress the occurrence of the failures caused by the heat in a plurality of series-connected pumps.

(Exemplary Specific Circuit Configuration of Control Unit 60)

The control units 60 according to the first and second embodiments described above can be obtained using, for example, the following configuration. FIG. 7 is a functional block diagram of a control unit in a fluid control device.

As illustrated in FIG. 7, the control unit 60 includes an MCU 61, a power supply circuit 621, a power supply circuit 622, a driving voltage generation circuit 631, a driving voltage generation circuit 632, and a valve control signal generation circuit 64. The control unit 60 includes a single IC corresponding to a "first control unit" and a "second control unit" of the present disclosure.

The MCU 61 is connected to the power supply circuits 621 and 622, the driving voltage generation circuits 631 and 632, and the valve control signal generation circuit 64. Power supply voltages are supplied from a battery 70 to the MCU 61 and the power supply circuits 621 and 622. The MCU 61 performs driving control of the power supply circuits 621 and 622, the driving voltage generation circuits 631 and 632, and the valve control signal generation circuit 64. For example, the control of a driving voltage value, the control of output timing of a driving voltage, and the control of output timing of a valve control signal are performed.

The power supply circuit 621 converts a power supply voltage into a voltage to be applied to the piezoelectric pump 21 and outputs the voltage to the driving voltage generation circuit 631. The power supply circuit 622 converts a power supply voltage into a voltage to be applied to the piezoelectric pump 22 and outputs the voltage to the driving voltage generation circuit 632.

The driving voltage generation circuit 631 converts a voltage from the power supply circuit 621 into a waveform for driving the piezoelectric pump 21 and outputs it to the piezoelectric pump 21.

The driving voltage generation circuit 632 converts a voltage from the power supply circuit 622 into a waveform for driving the piezoelectric pump 22 and outputs it to the piezoelectric pump 22.

The valve control signal generation circuit 64 generates a valve control signal for the closing control and a valve control signal for the opening control and outputs them to the valve 30.

The control unit 60 may have a configuration in which a first control unit for applying a driving voltage to a piezoelectric pump and a second control unit for outputting a control signal to a valve are provided separately. However, by packaging the first control unit and the second control unit into a single element, the driving signal (driving voltage) and the valve control signal can be easily synchronized with each other.

The control unit can be formed using the following various circuit configurations. FIG. 8 is a circuit diagram illustrating a first example of a control unit of a separately-excited oscillation type.

As illustrated in FIG. 8, a control unit 60X includes the MCU 61 and a driving voltage generation circuit 630. This circuit performs driving control upon a single piezoelectric pump (piezoelectric element 200).

Accordingly, in the case where a plurality of piezoelectric pumps are subjected to driving control as described above, the same number of driving voltage generation circuits 630 as the piezoelectric pumps is provided.

The driving voltage generation circuit 630 is a full bridge circuit including an FET 1, an FET 2, an FET 3, and an FET 4. The gates of the FETs 1, 2, 3, and 4 are connected to the MCU 61.

The drains of the FETs 1 and 3 are connected to each other. A voltage Vc obtained from the power supply voltage is supplied to the drains of the FETs 1 and 3.

The source of the FET 1 is connected to the drain of the FET 2, and the source of the FET 2 is connected to a control reference voltage (Vg point) of the control unit 60X via a resistance element Rs. The source of the FET 3 is connected to the drain of the FET 4, and the source of the FET 4 is connected to the control reference voltage (Vg point) of the control unit 60X. The reference potential (Vg point) of the control unit 60X is connected to the reference potential of the fluid control device 10 via the resistance element Rs.

A node between the source of the FET 1 and the drain of the FET 2 is connected to one terminal of the piezoelectric element 200, and a node between the source of the FET 3 and the drain of the FET 4 is connected to the other terminal of the piezoelectric element 200.

The MCU 61 performs, in a first control state, ON control (conduction control) of the FETs 1 and 4 and OFF control (open control) of the FETs 2 and 3. The MCU 61 performs, in a second control state, the OFF control (open control) of the FETs 1 and 4 and the ON control (conduction control) of the FETs 2 and 3. The MCU 61 performs the first control state and the second control state in this order. At that time, the MCU 61 performs the control in such a manner that the time period during which the first control state and the second control state are sequentially performed becomes equal to the period (inverse of a resonant frequency) of a piezoelectric pump (the piezoelectric element 200). As a result, a driving voltage is applied to the piezoelectric element 200, and the piezoelectric pump is driven.

Second Embodiment

Figure 9:
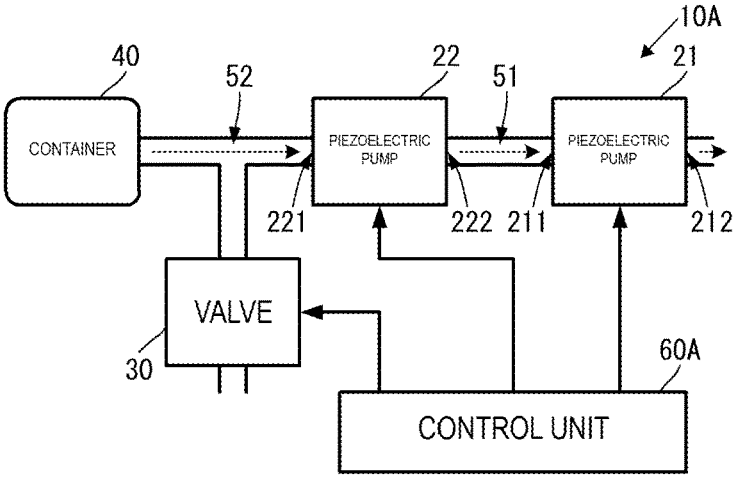
FIG. 9 is a block diagram illustrating the configuration of a fluid control device according to a second embodiment.

A fluid control device according to the second embodiment of the present disclosure will be described with reference to the drawings. FIG. 9 is a block diagram illustrating the configuration of a fluid control device according to the second embodiment.

As illustrated in FIG. 9, a fluid control device 10A according to the second embodiment differs from the fluid control device 10 according to the first embodiment in that the fluid control device 10A includes a control unit 60A. The other configuration of the fluid control device 10A is similar to that of the fluid control device 10, and the description thereof will be omitted. The control unit 60A differs from the control unit 60 according to the first embodiment in that the control unit 60A has a current limiting function. The other configuration of the control unit 60A is similar to that of the control unit 60, and the description thereof will be omitted.

When the current limiting is not performed, a driving current Idd1 for the piezoelectric pump 21, which is a downstream-side pump, is larger than a driving current Idd2 for the piezoelectric pump 22, which is an upstream-side pump.

The control unit 60A limits the driving current Idd1.

Figure 10A:
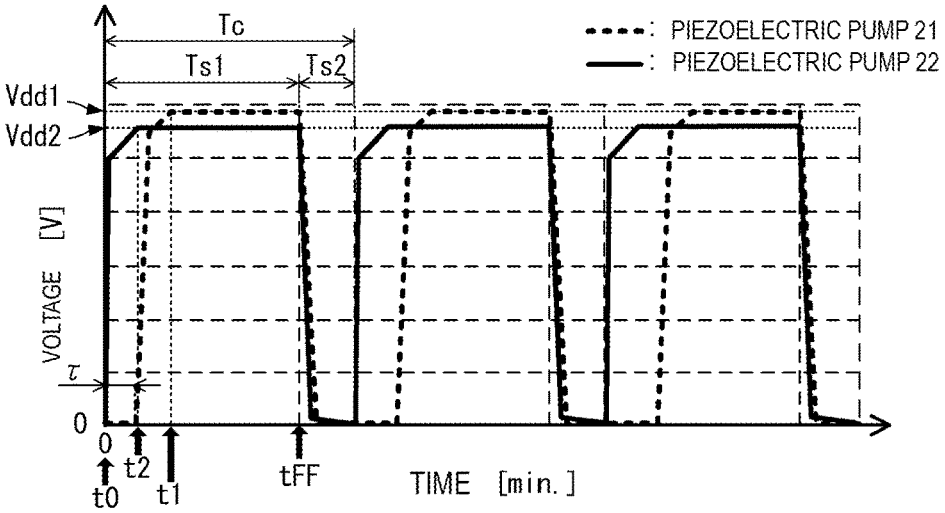
FIGS. 10A and 10B are diagrams illustrating the voltage waveform of a driving signal for each piezoelectric pump according to the second embodiment.
Figure 10B:
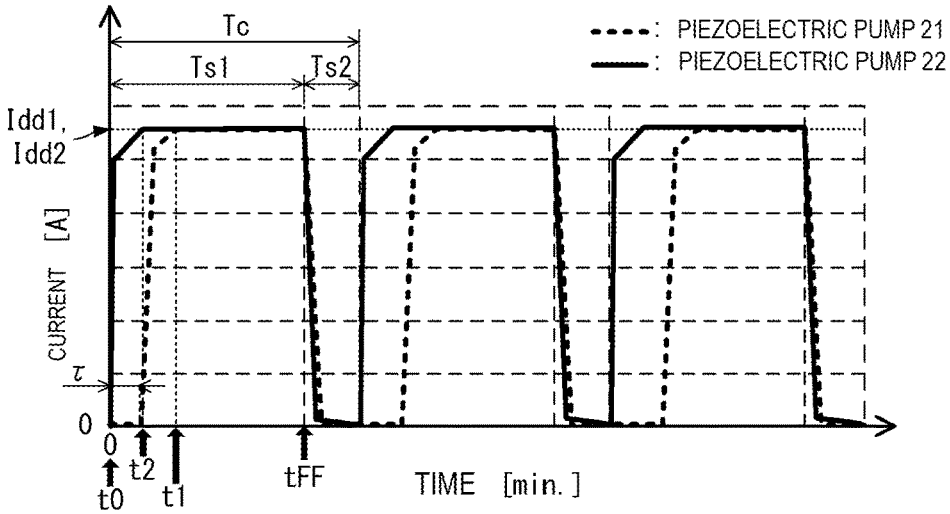

FIGS. 10A and 10B are diagrams illustrating the voltage waveform of a driving signal for each piezoelectric pump according to the second embodiment.

Specifically, as illustrated in FIG. 10B, the control unit 60A reduces the magnitude of the driving current Idd1 to make it equal to the magnitude of the driving current Idd2. The case where currents (current values) are equal described herein includes the case where the difference between current values is within 20% from the lower one of the current values. To achieve this, the control unit 60A makes the driving voltage Vdd1 higher than the driving voltage Vdd2.

Figure 11:
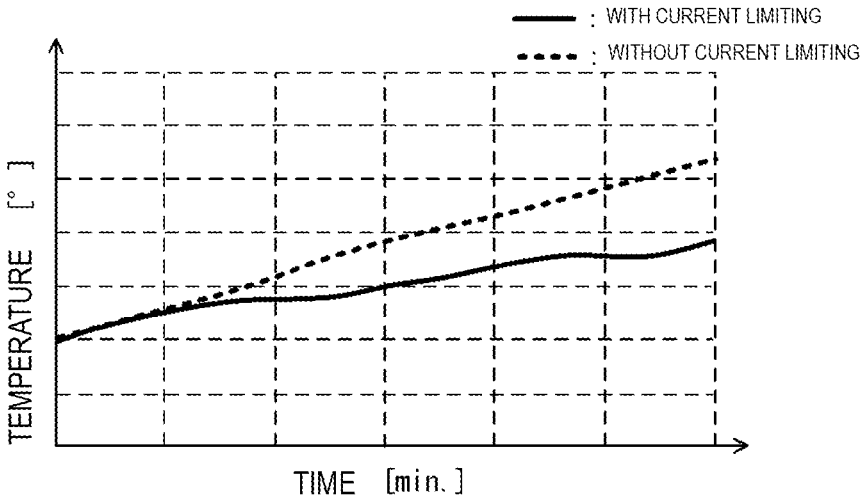
FIG. 11 is a diagram illustrating temperature change patterns with and without current limiting.

FIG. 11 is a diagram illustrating temperature change patterns with and without current limiting. FIG. 11 illustrates the temperatures of a downstream-side pump. Referring to FIG. 11, the solid line represents temperatures when the current limiting is performed, and the broken line represents temperatures when the current limiting is not performed.

As illustrated in FIG. 11, the performance of the current limiting decreases the rate of increase of temperature of the downstream-side pump.

Thus, the fluid control device 10A can suppress the increase in the temperature of the downstream-side pump while obtaining an operational effect similar to an operational effect obtained by the fluid control device 10.

(Exemplary Specific Circuit Configuration of Control Unit 60A)

Figures 12, 13:
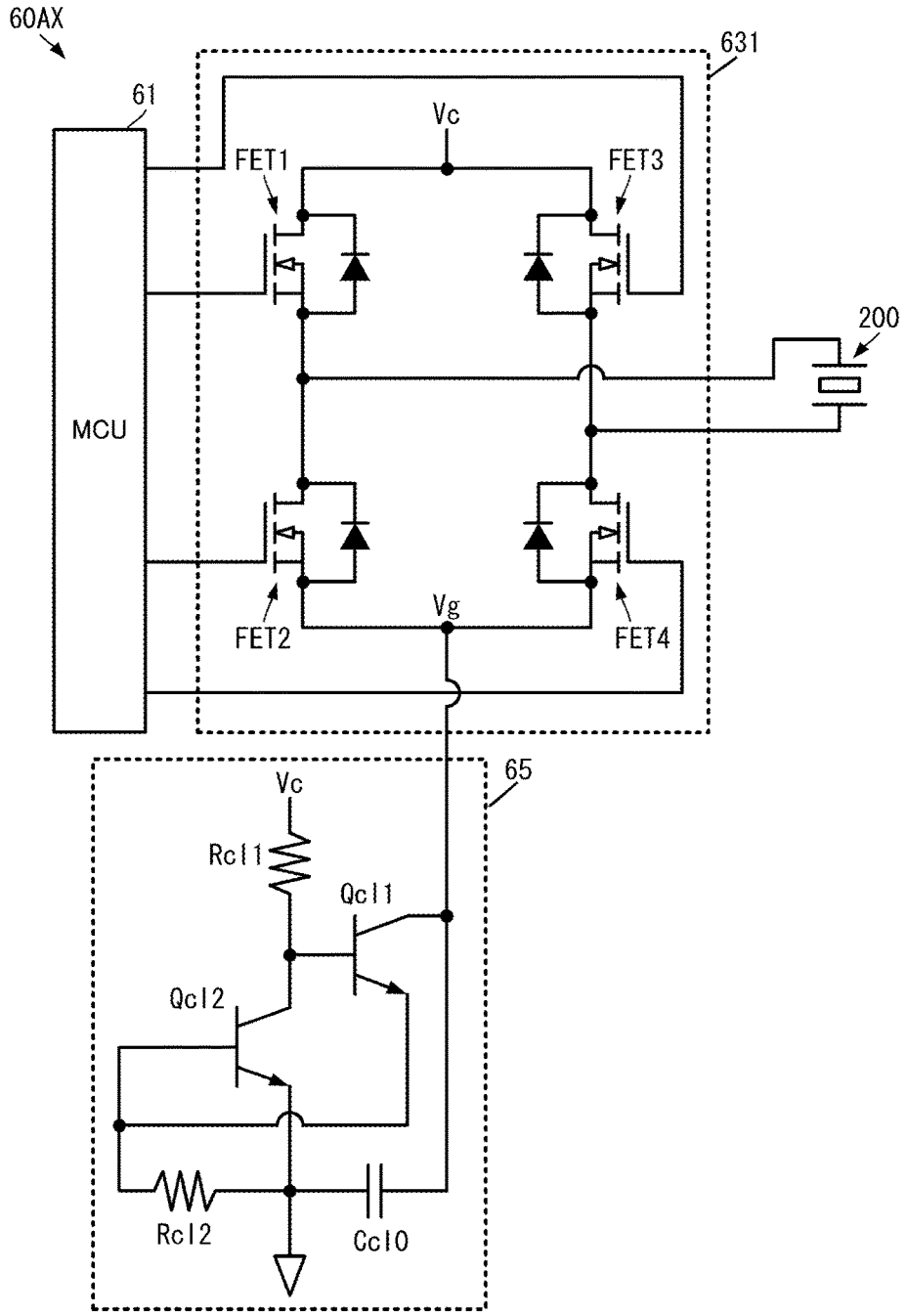
FIG. 12 is a circuit diagram illustrating an exemplary circuit configuration of a control unit according to the second embodiment.
FIG. 13 is a state transition diagram of control processing performed by a fluid control device according to a third embodiment.

The control unit 60A has, for example, the circuit configuration illustrated in FIG. 12 to achieve the above control. FIG. 12 is a circuit diagram illustrating an exemplary circuit configuration of a control unit according to the second embodiment. A control unit 60AX illustrated in FIG. 12 differs from the control unit 60X illustrated in FIG. 8 in that a current limiting circuit 65 is added. The other configuration of the control unit 60AX is similar to that of the control unit 60X, and the description thereof will be omitted.

The control unit 60AX includes the current limiting circuit 65. The current limiting circuit 65 is connected to at least the driving voltage generation circuit 631 for the piezoelectric pump 21.

The current limiting circuit 65 includes a transistor Qcl1, a transistor Qcl2, a transistor Rcl1, a resistance element Rcl2, and a capacitor Ccl0. The transistors Qcl1 and Qcl2 are ntn transistors.

The base of the transistor Qcl1 is connected to a supply point of the voltage Vc via the transistor Rcl1. The collector of the transistor Qcl1 is connected to a control reference voltage Vg (the node between the sources of the FETs 2 and 4). The collector of the transistor Qcl1 is also connected to the reference potential of the fluid control device 10 via the capacitor Ccl0.

The emitter of the transistor Qcl1 is connected to the base of the transistor Qcl2. The base of the transistor Qcl2 is connected to the reference potential of the fluid control device 10 via a resistance element Rcl2.

The collector of the transistor Qcl2 is connected to the base of the transistor Qcl1. The emitter of the transistor Qcl2 is connected to the reference potential of the fluid control device 10.

The current limiting circuit 65 having the above configuration can limit the magnitude of the driving current Idd1 flowing through the piezoelectric pump 21. At that time, by setting the resistance value of the resistance element Rcl2 and the capacitance of the capacitor Ccl0 as appropriate, the control unit 60AX can adjust the ON/OFF timings of the transistors Qcl1 and Qcl2 and make the magnitude of the driving current Idd1 equal to the magnitude of the driving current Idd2.

Third Embodiment

A fluid control device according to the third embodiment of the present disclosure will be described with reference to the drawings. A fluid control device according to the third embodiment differs from the fluid control device 10 according to the first embodiment in details of control processing. The other configuration and control processing of a fluid control device according to the third embodiment are similar to those of a fluid control device according to the first embodiment, and the description thereof will be omitted.

A fluid control device according to the third embodiment mainly performs a suction operation and also performs an exhaust operation. Specifically, a fluid control device according to the third embodiment performs control to be described below.

Figure 14:
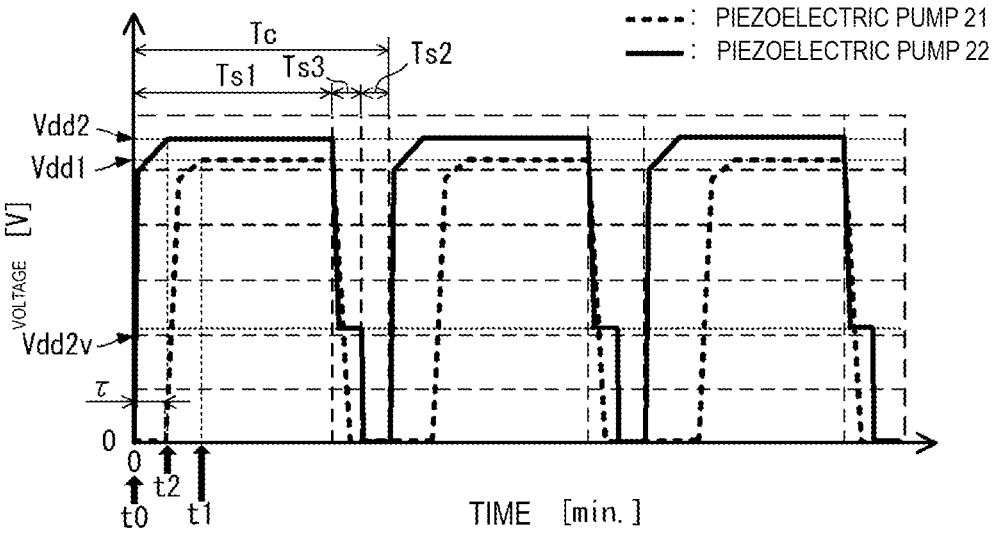
FIG. 14 is a diagram illustrating the voltage waveform of a driving signal for each piezoelectric pump according to the third embodiment.

FIG. 13 is a state transition diagram of control processing performed by a fluid control device according to the third embodiment. FIG. 14 is a diagram illustrating the voltage waveform of a driving signal for each piezoelectric pump according to the third embodiment.

As illustrated in FIG. 13, in a state ST1A synchronized with the start timing of a driving control cycle, a fluid control device starts the driving of the piezoelectric pump 22 (the piezoelectric pump 22: ON) and performs the closing control of the valve 30 (the valve 30: CL). At that time, the fluid control device 10 stops the piezoelectric pump 21 (the piezoelectric pump 21: OFF).

In a state ST2A subsequent to the state ST1A, the fluid control device maintains the closed state of the valve 30 (the valve 30: CL) and starts the driving of the piezoelectric pump 21 (the piezoelectric pump 21: ON) while maintaining the driving state of the piezoelectric pump 22 (the piezoelectric pump 22: ON).

In a state ST3A subsequent to the state ST2A, the fluid control device performs the opening control of the valve 30 (the valve: OP) and stops the piezoelectric pump 21 (the piezoelectric pump 21: OFF). At that time, the fluid control device maintains the driving of the piezoelectric pump 22 (the piezoelectric pump 22: ON). Here, the fluid control device makes a driving voltage Vdd2*v* for the piezoelectric pump 22 lower than the driving voltage Vdd2 in the state ST2A (see FIG. 14).

That is, the fluid control device sets the driving voltage Vdd2*v* for the piezoelectric pump 22 to an exhaust driving voltage in the state ST3A. The exhaust driving voltage is a voltage at which almost no fluid is sucked from the container 40 and an external fluid (e.g., air) can be sucked from the valve 30 and discharged to the outside via the communicating path 52, the piezoelectric pump 22, the communicating path 51, and the piezoelectric pump 21.

In a state ST4A subsequent to the state ST3A, the fluid control device maintains the open state of the valve 30 (the valve 30: OP) and stops the piezoelectric pumps 21 and 22 (the piezoelectric pumps 21 and 22: OFF).

That is, as illustrated in FIG. 14, the fluid control device shortens the non-driving time Ts2 in the fluid control device 10 described above. The fluid control device sets an exhaust time Ts3 between the driving time Ts1 and the non-driving time Ts2.

The fluid control device performs a set of these states ST1A, ST2A, ST3A, and ST4A in one driving control cycle and repeats this control.

Thus, in one driving control cycle, the fluid control device drives the upstream-side pump earlier than the downstream-side pump and performs exhaust by driving only the upstream-side pump.

Figure 15:
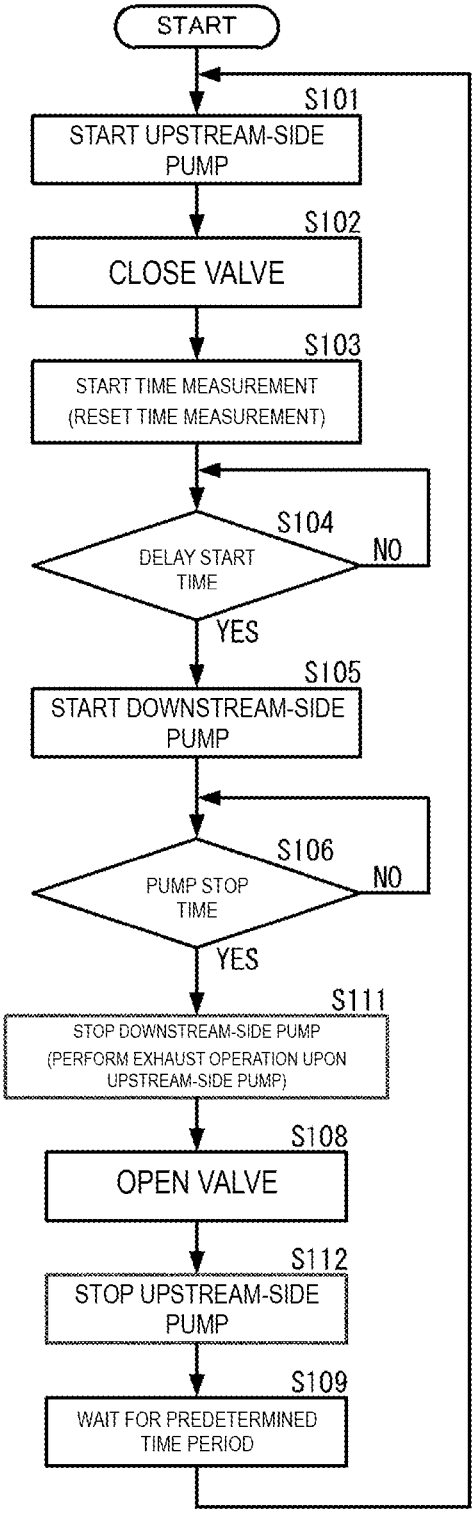
FIG. 15 is a flowchart of a control process performed by a fluid control device according to the third embodiment of the present disclosure.

For achievement of this control, a control unit in the fluid control device performs the control process illustrated in FIG. 15. FIG. 15 is a flowchart of a control process performed by a fluid control device according to the third embodiment of the present disclosure.

As illustrated in FIG. 15, a control unit starts an upstream-side pump (the piezoelectric pump 22 in the third embodiment) at the start timing of one driving control cycle (S101). The control unit performs closing control of the valve 30 (S102). The control unit starts time measurement or resets the time measurement when the control is in progress (S103). Steps S101, S102, and S103 are performed at substantially the same time. Step S101, S102, and S103 may be performed with some time differences or the order of these steps may be replaced, within the range where the functions of the fluid control device can be achieved.

The control unit refers to the measured time and continues the time measurement until a delay start time (S104: NO). Upon reaching the delay start time (S104: YES), the control unit starts a downstream-side pump (the piezoelectric pump 21 in the third embodiment) (S105).

The control unit causes the upstream-side pump and the downstream-side pump to continue respective operations until a pump stop time (S106: NO).

Upon reaching the pump stop time (S106: YES), the control unit stops the downstream-side pump (S111). The control unit performs the opening control of the valve 30 (S108). Steps S111 and S108 are performed at substantially the same time. Steps S111 and S108 may be performed with some time differences within the range where the functions of the fluid control device can be achieved.

The control unit stops the upstream-side pump after a lapse of a predetermined time period (exhaust time period) from step S111 (S112).

The fluid control device waits for a predetermined time period again in the state where the upstream-side pump and the downstream-side pump stop and the valve 30 is under the opening control (S109), ends one driving control cycle, and returns to step S101.

Thus, a fluid control device according to the third embodiment performs an exhaust operation using only an upstream-side pump. An upstream-side pump (the piezoelectric pump 22 in the above example) has a larger temperature difference between a suck side (the communicating path 52 side) and an exhaust side (the communicating path 51 side) than a downstream-side pump (the piezoelectric pump 21 in the above example). Thus, the larger the temperature difference is, the larger the temperature reduction effect obtained by exhaust is. Accordingly, when a fluid control device according to the third embodiment performs control, the increase in the temperature of the upstream-side pump can be suppressed and the temperature of a fluid to be sucked into the downstream-side pump can also be reduced. This leads to the suppression of increase in the temperature of the downstream-side pump.

FIG. 16 is a diagram illustrating temperature change patterns with and without exhaust. Referring to FIG. 16, the horizontal axis represent time and the vertical axis represents temperature. Referring to FIG. 16, the thick solid line represents the temperature of a downstream-side pump when exhaust is performed, the thick broken line represents the temperature of an upstream-side pump when exhaust is performed, and the thin broken line represents the temperature of the downstream-side pump when exhaust is not performed. Referring to FIG. 16, Tc represents the above driving control cycle.

As illustrated in FIG. 16, with the configuration and the control of a fluid control device according to the third embodiment, the temperature of a downstream-side pump can be reduced and the temperatures of an upstream-side pump and the downstream-side pump can be balanced while the above operational effect can be obtained. As a result, the fluid control device can further suppress the occurrence of a failure.

Fourth Embodiment

A fluid control device according to the fourth embodiment of the present disclosure will be described with reference to the drawing. A fluid control device according to the fourth embodiment differs from a fluid control device according to the third embodiment in that the fluid control device according to the fourth embodiment performs current limiting like a fluid control device according to the second embodiment. The other configuration and control processing of a fluid control device according to the fourth embodiment are similar to those of a fluid control device according to the third embodiment, and the description thereof will be omitted.

FIG. 17 is a diagram illustrating temperature change patterns when both current limiting and exhaust are performed and a temperature change pattern when neither current limiting nor exhaust is performed. Referring to FIG. 17, the horizontal axis represent time and the vertical axis represents temperature. Referring to FIG. 17, the thick solid line represents the temperature of a downstream-side pump when both current limiting and exhaust are performed, the thick broken line represents the temperature of an upstream-side pump when both current limiting and exhaust are performed, and the thin broken line represents the temperature of the downstream-side pump when neither current limiting nor exhaust is performed. Referring to FIG. 17, Tc represents the above driving control cycle.

As illustrated in FIG. 17, with the configuration and the control of a fluid control device according to the fourth embodiment, the increase in temperature can be further suppressed while the temperatures of an upstream-side pump and a downstream-side pump can be balanced and the above operational effect can be obtained. As a result, the fluid control device can further suppress the occurrence of a failure.

Fifth Embodiment

A fluid control device according to the fifth embodiment of the present disclosure will be described with reference to the drawings. A fluid control device according to the fifth embodiment differs from a fluid control device according to the third embodiment in that the order of the exhaust time Ts3 and the non-driving time Ts2 are reversed. The other configuration and control processing of a fluid control device according to the fifth embodiment are similar to those of a fluid control device according to the third embodiment, and the description thereof will be omitted.

Figure 19:
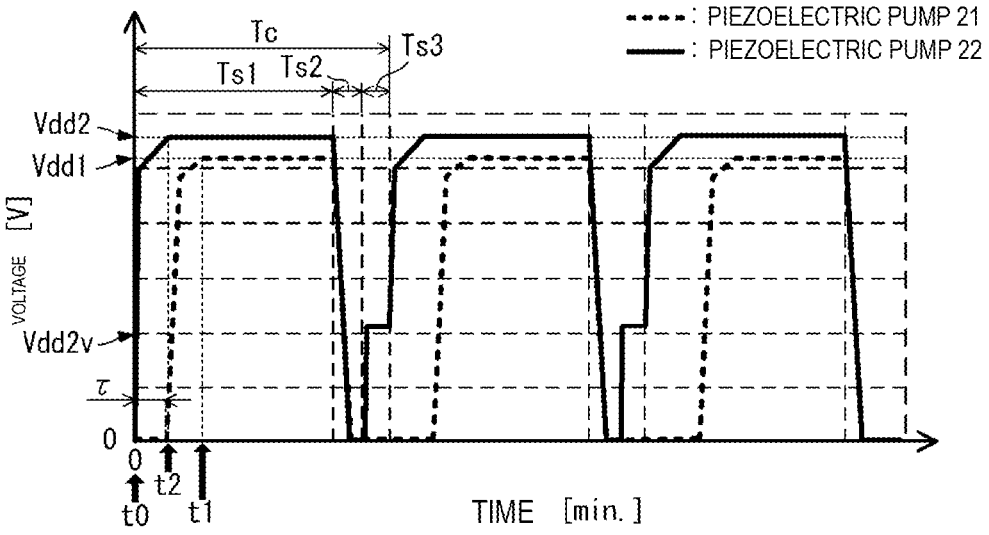
FIG. 19 is a diagram illustrating the voltage waveform of a driving signal for each piezoelectric pump according to the fifth embodiment.

FIG. 18 is a state transition diagram of control processing performed by a fluid control device according to the fifth embodiment. FIG. 19 is a diagram illustrating the voltage waveform of a driving signal for each piezoelectric pump according to the fifth embodiment.

As illustrated in FIG. 18, in a state ST1B synchronized with the start timing of a driving control cycle, a fluid control device starts the driving of the piezoelectric pump 22 (the piezoelectric pump 22: ON) and performs the closing control of the valve 30 (the valve 30: CL). At that time, the fluid control device 10 stops the piezoelectric pump 21 (the piezoelectric pump 21: OFF).

In a state ST2B subsequent to the state ST1B, the fluid control device maintains the closed state of the valve 30 (the valve 30: CL) and starts the driving of the piezoelectric pump 21 (the piezoelectric pump 21: ON) while maintaining the driving state of the piezoelectric pump 22 (the piezoelectric pump 22: ON).

In a state ST3B subsequent to the state ST2B, the fluid control device performs the opening control of the valve 30 (the valve 30: OP) and stops the piezoelectric pumps 21 and 22 (the piezoelectric pumps 21 and 22: OFF).

In a state ST4B subsequent to the state ST3B, the fluid control device maintains the open state of the valve 30 and the stop state of the piezoelectric pump 21 (the valve: OP, the piezoelectric pump 21: OFF) and starts the driving of the piezoelectric pump 22 (the piezoelectric pump 22: ON). Here, the fluid control device makes the driving voltage Vdd2*v* for the piezoelectric pump 22 lower than the driving voltage Vdd2 in the state ST2B (see FIG. 19).

That is, the fluid control device sets the driving voltage Vdd2*v* for the piezoelectric pump 22 to the above exhaust driving voltage in the state ST4B.

That is, as illustrated in FIG. 19, the fluid control device shortens the non-driving time Ts2 in the fluid control device 10 described above. The fluid control device sets the exhaust time Ts3 between the non-driving time Ts2 and the driving time Ts1 in the next driving control cycle.

The fluid control device performs a set of these states ST1B, ST2B, ST3B, and ST4B in one driving control cycle and repeats this control. That is, the fluid control device continuously performs driving control upon the upstream-side pump in the order from exhaust driving to suction driving while changing a driving voltage.

Thus, the fluid control device drives the upstream-side pump earlier than the downstream-side pump and performs exhaust by driving only the upstream-side pump in one driving control cycle and performs the driving of the upstream-side pump in the next cycle subsequent to this exhaust.

Figure 20:
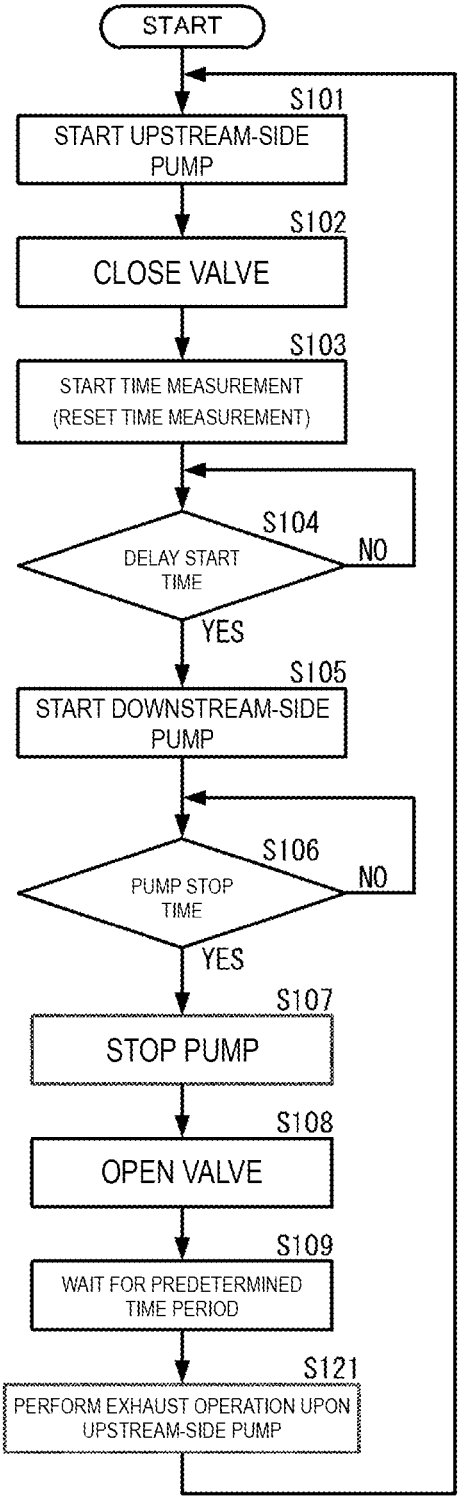
FIG. 20 is a flowchart of a control process performed by a fluid control device according to the fifth embodiment of the present disclosure.

For achievement of this control, a control unit in the fluid control device performs the control process illustrated in FIG. 20. FIG. 20 is a flowchart of a control process performed by a fluid control device according to the fifth embodiment of the present disclosure.

As illustrated in FIG. 20, a control unit starts an upstream-side pump (the piezoelectric pump 22 in the fifth embodiment) at the start timing of one driving control cycle (S101). The control unit performs closing control of the valve 30 (S102). The control unit starts time measurement or resets the time measurement when the control is in progress (S103). Steps S101, S102, and S103 are performed at substantially the same time. Steps S101, S102, and S103 may be performed with some time differences or the order of these steps may be replaced, within the range where the functions of the fluid control device can be achieved.

The control unit refers to the measured time and continues the time measurement until a delay start time (S104: NO). Upon reaching the delay start time (S104: YES), the control unit starts a downstream-side pump (the piezoelectric pump 21 in the fifth embodiment) (S105).

The control unit causes the upstream-side pump and the downstream-side pump to continue respective operations until a pump stop time (S106: NO).

Upon reaching the pump stop time (S106: YES), the control unit stops the upstream-side pump and the downstream-side pump (S107). The control unit performs the opening control of the valve 30 (S108). Steps S107 and S108 are performed at substantially the same time. Steps S107 and S108 may be performed with some time differences within the range where the functions of the fluid control device can be achieved.

The fluid control device stops the upstream-side pump and the downstream-side pump and waits for a predetermined time period in the state where the valve 30 is under the opening control (S109). After waiting for the predetermined time period, the fluid control device starts the driving of the upstream-side pump as an exhaust operation (S121). After performing the exhaust operation for a predetermined time period, the fluid control device ends one driving control cycle and returns to step S101.

Even with the above configuration and the above control, a fluid control device according to the fifth embodiment can obtain an operational effect similar to an operational effect obtained by a fluid control device according to the third embodiment. Furthermore, a fluid control device according to the fifth embodiment can perform exhaust with more certainty even if the opening control timing of the valve 30 delays.

A fluid control device according to the fifth embodiment may perform control illustrated in FIG. 21. FIG. 21 is a diagram illustrating the voltage waveform of a driving signal for each piezoelectric pump according to the fifth embodiment.

As illustrated in FIG. 21, a fluid control device according to the fifth embodiment sets the exhaust time Ts3 in the middle of the non-driving time Ts2. That is, the driving time Ts1 and the exhaust time Ts3 are set in a discontinuous manner. Even with this control, a fluid control device according to the fifth embodiment can obtain an operational effect similar to the operational effect described above.

Sixth Embodiment

A fluid control device according to the sixth embodiment of the present disclosure will be described with reference to the drawings. FIG. 22 is a block diagram illustrating the configuration of a fluid control device according to the sixth embodiment of the present disclosure.

As illustrated in FIG. 22, a fluid control device 10B according to the sixth embodiment is a device in which the flow of a fluid is reversed as compared with the fluid control device 10 according to the first embodiment. The description of parts of the fluid control device 10B similar to those of the fluid control device 10 will be omitted. The fluid control device 10B is used in, for example, a blood pressure monitor.

In the fluid control device 10B, the hole 212 of the piezoelectric pump 21 and the hole 221 of the piezoelectric pump 22 communicate with each other via the communicating path 51. The hole 222 of the piezoelectric pump 22 and a container 40B communicate with each other via the communicating path 52. Accordingly, in the fluid control device 10B, the piezoelectric pump 21 is an upstream-side pump, and the piezoelectric pump 22 is a downstream-side pump.

Like the fluid control device 10, the fluid control device 10B in which a fluid flows into the container 40B can also suppress the occurrence of failures caused by the heat including breakage of a plurality of series-connected pumps by performing the above control upon the upstream-side pump and the downstream-side pump.

(Another Method of Achieving Current Limiting Function)

Figure 23:
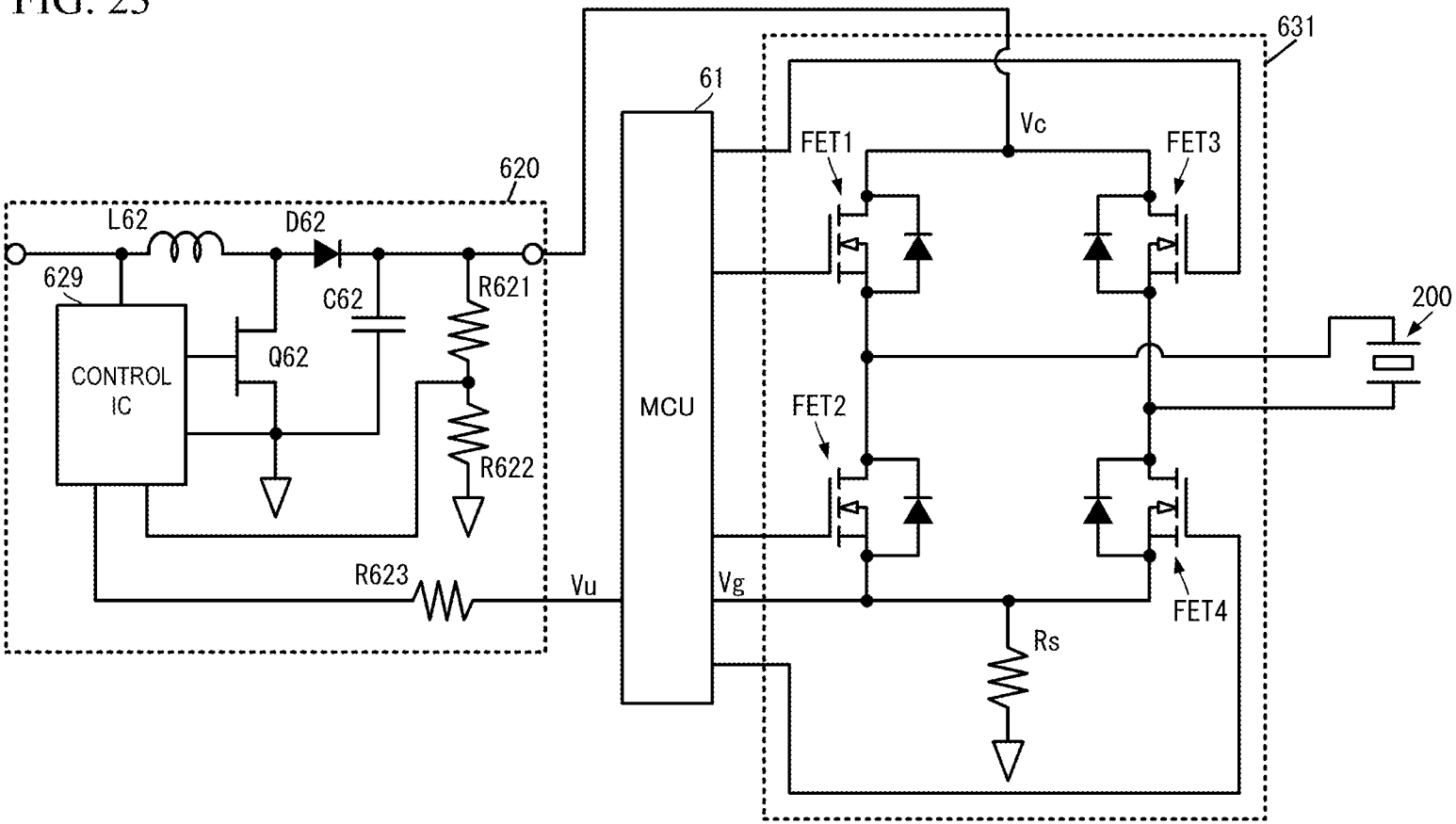
FIG. 23 is a circuit diagram illustrating the configuration of a control unit having a current limiting function.

FIG. 23 is a circuit diagram illustrating the configuration of a control unit having a current limiting function. FIG. 23 illustrates only a part regarding a control performed by a control unit upon an upstream-side pump, and the other part can be obtained with the above configuration.

As illustrated in FIG. 23, the driving voltage generation circuit 631 has a configuration similar to that of the driving voltage generation circuit 630 illustrated in FIG. 8.

The MCU 61 measures the control reference voltage Vg of the driving voltage generation circuit 631. The MCU 61 generates a current control signal (current control voltage) Vu in accordance with the level of the control reference voltage Vg and outputs the current control signal Vu to a power supply circuit 620. The level of the control reference voltage Vg is based on a current I (corresponding to the driving current Idd1) flowing through the resistance element Rs. The MCU 61 generates the current control signal (current control voltage) Vu from the control reference voltage Vg corresponding to the driving current Idd1 such that the driving current Idd1 has the same level as the driving current Idd2, and outputs the current control signal Vu to the power supply circuit 620.

The power supply circuit 620 include, for example, the control IC 629, a switching element Q62, an inductor L62, a diode D62, a capacitor C62, a resistance element R621, a resistance element R622, and a resistance element R623 as illustrated in FIG. 23. The control IC 629 is connected to the input terminal of the power supply circuit 620 to receive power from an external power supply and performs ON/OFF control of the switching element Q62. The inductor L62 and a diode D62 are connected to a power supply line between the input terminal and output terminal of the power supply circuit 620. The capacitor C62 is connected between the output terminal and the reference potential of the power supply circuit 620 (the reference potential of a fluid control device).

The gate of the switching element Q62 is connected to the control IC 629, the drain of the switching element Q62 is connected to the output side of the inductor L62, and the source of the switching element Q62 is connected to the reference potential.

A series circuit of the resistance elements R621 and R622 is connected between the output terminal and the reference potential. A voltage division point between the resistance elements R621 and R622 is connected to the control IC 629. The resistance element R623 is connected between the MCU 61 and the control IC 629.

The power supply circuit 620 controls the voltage Vc to be applied to the driving voltage generation circuit 631 to a predetermined value by the ON/OFF control of the switching element Q62 performed by the control IC 629. At that time, the voltage dividing of the voltage Vc by the resistance elements R621 and R622 is fed back to the control IC 629. The control IC 629 refers to this voltage and controls the voltage Vc substantially constant.

The control IC 629 adjusts the voltage Vc by referring to the current control signal (current control voltage) Vu from the MCU 61 and adjusting switching control. For example, upon receiving the current control signal (current control voltage) Vu for which current limiting is needed, the control IC 629 adjusts switching control to reduce the voltage Vc for a downstream-side pump.

With the above circuit configuration and the above control, the above current limiting can be achieved.

This control is achieved when a fluid is sucked from the container 40. When a fluid is flowed into the container 40, the control unit adjusts switching control to increase the voltage Vc for an upstream-side pump.

(Driving Voltage Generation Circuit According to Another Aspect)

Figure 24:
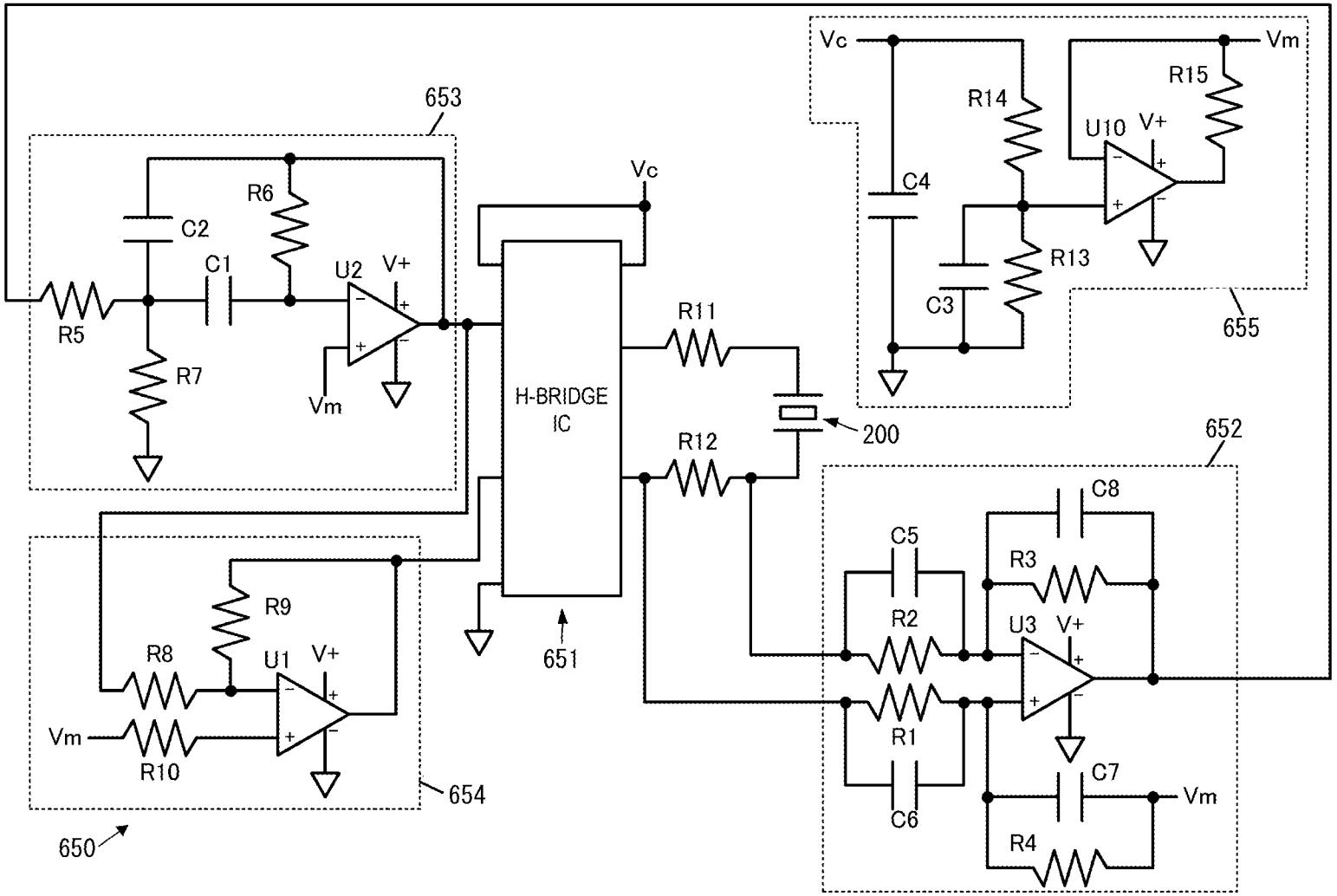
FIG. 24 is a circuit diagram illustrating an example of a driving voltage generation circuit of a self-excited oscillation type.

FIG. 24 is a circuit diagram illustrating an example of a driving voltage generation circuit of a self-excited oscillation type. As illustrated in FIG. 24, a driving voltage generation circuit 650 includes the H-bridge IC 651, a differential circuit 652, an amplification circuit 653, a phase inversion circuit 654, and an intermediate voltage generation circuit 655. In outline, the driving voltage generation circuit 650 operates in the following manner.

The H-bridge IC 651, to which the voltage Vc is supplied, outputs driving voltages having the same absolute value and opposite phases from a first output terminal and a second output terminal thereof upon receiving the outputs of the amplification circuit 653 and the phase inversion circuit 654 and supplies these driving voltages to the piezoelectric element 200. The piezoelectric element 200 is excited upon receiving the driving voltages, and a piezoelectric pump is driven.

The differential circuit 652 differentially amplifies a voltage across a resistance element R12 based on a current flowing through the piezoelectric element 200 and outputs the voltage to the amplification circuit 653. The amplification circuit 653 amplifies the output voltage of the differential circuit 652 and outputs the voltage to the H-bridge IC 651 and the phase inversion circuit 654. The phase inversion circuit 654 inverts the phase of the output voltage of the amplification circuit 653 and outputs the voltage to the H-bridge IC 651.

When such feedback control is performed, the piezoelectric element 200 is driven at an optimum frequency based on the impedances of respective circuit elements constituting the driving voltage generation circuit 650 and the piezoelectric element 200.

As illustrated in FIG. 24, a specific circuit configuration of the driving voltage generation circuit 650 is, for example, the following circuit configuration.

The intermediate voltage generation circuit 655 includes an operational amplifier U10, a resistance element R13, a resistance element R14, a resistance element R15, a capacitor C3, and a capacitor C4.

The resistance elements R14 and R13 are connected in series in this order between a supply point of the voltage Vc and the reference potential. The capacitor C3 is connected in parallel to the resistance element R13. The capacitor C4 is connected in parallel to a series circuit of the resistance elements R14 and R13. A non-inverting input terminal of the operational amplifier U10 is connected to a node between the resistance elements R13 and R14. An output terminal of the operational amplifier U10 is connected to an inverting input terminal of the operational amplifier U10 via the resistance element R15. The intermediate voltage generation circuit 655 outputs, as an intermediate voltage Vm, a voltage of a terminal of the resistance element R15 opposite a terminal connected to the output terminal of the operational amplifier U10.

A first output terminal of the H-bridge IC 651 is connected to one of the terminals of the piezoelectric element 200 via a resistance element R11. A second output terminal of the H-bridge IC 651 is connected to the other terminal of the piezoelectric element 200 via a resistance element R12.

The differential circuit 652 includes an operational amplifier U3, a resistance element R1, a resistance element R2, a resistance element R3, a resistance element R4, a capacitor C5, a capacitor C6, a capacitor C7, and a capacitor C8.

A driving voltage V+ is supplied to the operational amplifier U3. An inverting input terminal of the operational amplifier U3 is connected to the piezoelectric element 200 side of the resistance element R12 for current detection via a parallel circuit of the resistance element R2 and the capacitor C5. A non-inverting input terminal of the operational amplifier U3 is connected to the H-bridge IC 651 side of the resistance element R12 via a parallel circuit of the resistance element R1 and the capacitor C6. The intermediate voltage Vm is supplied to the non-inverting input terminal of the operational amplifier U3 via a parallel circuit of the resistance element R4 and the capacitor C7. An output terminal of the operational amplifier U3 is connected to an inverting input terminal of the operational amplifier U3 via a parallel circuit of the resistance element R3 and the capacitor C8.

The amplification circuit 653 includes an operational amplifier U2, a resistance element R5, a resistance element R6, a resistance element R7, a capacitor C1, and a capacitor C2.

The driving voltage V+ is supplied to the operational amplifier U2. An inverting input terminal of the operational amplifier U2 is connected to the output terminal of the operational amplifier U3 in the differential circuit 652 via the capacitor C1 and the resistance element R5. A node between the capacitor C1 and the resistance element R5 is connected to the reference potential via the resistance element R7. One terminal of the capacitor C2 is connected to the node between the capacitor C1 and the resistance element R5, and the other terminal of the capacitor C2 is connected to one terminal of the resistance element R6. The other terminal of the resistance element R6 is connected to an inverting input terminal of the operational amplifier U2. The intermediate voltage Vm is supplied to a non-inverting input terminal of the operational amplifier U2. An output terminal of the operational amplifier U2 is connected to the one terminal of the resistance element R6. The output terminal of the operational amplifier U2 is also connected to the H-bridge IC 651.

The phase reversing circuit 654 includes an operational amplifier U1, a resistance element R8, a resistance element R9, and a resistance element R10.

The driving voltage V+ is supplied to the operational amplifier U1. An inverting input terminal of the operational amplifier U1 is connected to the output terminal of the operational amplifier U2 in the amplification circuit 653 via the resistance element R8. The intermediate voltage Vm is supplied to a non-inverting input terminal of the operational amplifier U1 via the resistance element R10. An output terminal of the operational amplifier U1 is connected to the inverting input terminal of the operational amplifier U1 via the resistance element R9. The output terminal of the operational amplifier U1 is also connected to the H-bridge IC 651.

The configurations of the above-described embodiments may be combined as appropriate, and the combined configurations can obtain respective operational effects.

10 fluid control device
10A fluid control device
10B fluid control device
21 piezoelectric pump
22 piezoelectric pump
30 valve

40 and 40B container
51 and 52 communicating path
60, 60A, 60AX and 60X control unit
61 MCU
64 valve control signal generation circuit
65 current limiting circuit
70 battery
200 piezoelectric element
211, 212, 221 and 222 hole
620, 621 and 622 power supply circuit
629 control IC
630, 631, 632 and 650 driving voltage generation circuit
651 H-bridge IC
652 differential circuit
653 amplification circuit
654 phase inversion circuit
655 intermediate voltage generation circuit
C1, C2, C3, C4, C5, C6, C62, C7, C8 and Ccl0 capacitor
D2 and D62 diode
L62 inductor
Q62 switching element
Qcl1 and Qcl2 transistor
R1, R2, R3, R4, R5, R6, R7, R8, R9, R10, R11, R12, R13, R14, R15, R621, R622, R623, Rcl1, Rcl1, Rcl2, Rs and Rs2 resistance element
U1, U10, U2 and U3 operational amplifier

The invention claimed is:

1. A fluid control device comprising:

a first pump having a first hole and a second hole and configured to move a fluid between the first hole and the second hole;

a second pump having a third hole and a fourth hole and configured to move a fluid between the third hole and the fourth hole;

a container;

a first communicating path communicating with the second hole and the third hole;

a second communicating path communicating with the fourth hole and the container; and a first control unit configured to control driving of the first pump and the second pump, a valve provided in the second communicating path and configured to switch between opening the second communicating path to outside and closing the second communicating path from the outside; and a second control unit configured to control opening and closing of the valve, wherein the first control unit starts or stops driving of the first pump and the second pump, wherein the first control unit makes a driving start timing of an upstream-side pump with respect to the fluid earlier than a driving start timing of a downstream-side pump with respect to the fluid, the upstream-side pump being one of the first pump and the second pump, the downstream-side pump being another one of the first pump and the second pump, and wherein the second control unit starts closing the valve at the driving start timing of the upstream-side pump and starts opening the valve when at least the first pump or the second pump stops.

2. The fluid control device according to claim 1, wherein the first control unit repeats control of the first pump and control of the second pump in a predetermined driving control cycle, and wherein, in the driving control cycle, the first control unit makes the driving start timing of the upstream-side pump earlier than the driving start timing of the downstream-side pump.

3. The fluid control device according to claim 1, wherein the first control unit reduces a current value for the downstream-side pump.

4. The fluid control device according to claim 3, wherein the first control unit makes the current value for the downstream-side pump and a current value for the upstream-side pump equal to each other.

5. The fluid control device according to claim 1, wherein the first control unit is comprised of an MCU functioning as a control factor of a temperature change by starting and stopping the driving of the first pump and the second pump and instructing a current value.

6. The fluid control device according to claim 1, wherein a driving time of the first pump is greater than a driving time of the second pump.

7. The fluid control device according to claim 1, wherein the second control unit controls a pressure of the container by opening or closing the valve.

8. The fluid control device according to claim 1, wherein the first control unit drives the upstream-side pump or the downstream-side pump in a part of a period in which the valve opens, and wherein the first control unit makes a driving voltage for the upstream-side pump or the downstream-side pump to be driven lower than the driving voltage when the valve closes.

9. The fluid control device according to claim 8, wherein the first control unit drives only the upstream-side pump in the part of the period in which the valve opens.

10. The fluid control device according to claim 7, wherein the first control unit performs driving in a period in which the valve opens in succession after driving in a period in which the valve closes.

11. The fluid control device according to claim 1, wherein a voltage for the upstream-side pump during driving has a higher transient change rate than a voltage for the downstream-side pump during the driving.

12. The fluid control device according to claim 2, wherein the first control unit reduces a current value for the downstream-side pump.

13. The fluid control device according to claim 2, wherein the first control unit is comprised of an MCU functioning as a control factor of a temperature change by starting and stopping the driving of the first pump and the second pump and instructing a current value.

14. The fluid control device according to claim 3, wherein the first control unit is comprised of an MCU functioning as a control factor of a temperature change by starting and stopping the driving of the first pump and the second pump and instructing a current value.

15. The fluid control device according to claim 4 wherein the first control unit is comprised of an MCU functioning as a control factor of a temperature change by starting and stopping the driving of the first pump and the second pump and instructing a current value.

16. The fluid control device according to claim 7, wherein the first control unit drives the upstream-side pump or the downstream-side pump in a part of a period in which the valve opens, and wherein the first control unit makes a driving voltage for the upstream-side pump or the downstream-side pump to be driven lower than the driving voltage when the valve closes.

* * * * *